US009606481B2

(12) United States Patent
Dedic

(10) Patent No.: US 9,606,481 B2
(45) Date of Patent: Mar. 28, 2017

(54) METHOD AND DEVICE FOR DIGITAL PRINTING TO A RECORDING MEDIUM WITH LIQUID INK

(71) Applicant: Oce Printing Systems GmbH & Co. KG, Poing (DE)

(72) Inventor: Revdin Dedic, Markt Schwaben (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/047,689

(22) Filed: Feb. 19, 2016

(65) Prior Publication Data

US 2016/0246222 A1 Aug. 25, 2016

(30) Foreign Application Priority Data

Feb. 19, 2015 (DE) ..... 10 2015 102 341

(51) Int. Cl.
*G03G 15/20* (2006.01)

(52) U.S. Cl.
CPC ..... *G03G 15/2014* (2013.01)

(58) Field of Classification Search
USPC ..... 399/38, 42, 57, 67–70, 122, 237, 250; 347/100, 103
See application file for complete search history.

(56) References Cited

U.S. PATENT DOCUMENTS

| | | | |
|---|---|---|---|
| 8,509,656 | B2 | 8/2013 | Kopp |
| 8,737,885 | B1 | 5/2014 | Berg |
| 8,849,171 | B2 | 9/2014 | Dedic et al. |

FOREIGN PATENT DOCUMENTS

| | | | |
|---|---|---|---|
| DE | 102006012940 | B3 | 9/2007 |
| DE | 102008048256 | A1 | 4/2010 |
| DE | 102009060334 | A1 | 6/2011 |
| DE | 102010015985 | A1 | 9/2011 |
| DE | 102010017239 | A1 | 12/2011 |
| DE | 102012111791 | A1 | 6/2014 |
| EP | 1155844 | A2 | 11/2001 |

*Primary Examiner* — Hoan Tran
(74) *Attorney, Agent, or Firm* — Schiff Hardin LLP

(57) ABSTRACT

Methods and devices for digital printing to a recording medium are described. The printing can use a liquid print ink that includes a flammable carrier. Print control data can be generated from print data and the print control data can activate one or more print groups to print to the recording medium. An areal coverage can be determined based on the print control data. The areal coverage corresponds to a quantity of color applied onto the recording medium. The determined areal coverage can be limited to a predetermined maximum average areal coverage within a predetermined averaging area. The predetermined maximum average areal coverage can be less than a maximum theoretical areal coverage. The recording medium can be heated in, for example, a heating chamber. The predetermined averaging area can be smaller than an area of the recording medium located within the heating chamber.

14 Claims, 3 Drawing Sheets

METHOD AND DEVICE FOR DIGITAL PRINTING TO A RECORDING MEDIUM WITH LIQUID INK

CROSS REFERENCE TO RELATED APPLICATIONS

This patent application claims priority to German Patent Application No. 102015102341.5, filed Feb. 19, 2015, which is incorporated herein by reference in its entirety.

BACKGROUND

The present disclosure concerns a method and a device for digital printing to a recording medium with liquid ink.

In digital printing, both liquid toner and liquid colors are used as ink.

Devices for digital printing to a recording medium with liquid toner are liquid toner printing apparatuses, in which toner particles are applied to the recording medium to be printed to with the aid of a liquid developer. Such devices are known from DE 10 2010 015 985 A1, DE 10 2008 048 256 A1, DE 10 2009 060 334 A1 or DE 10 2012 111 791 A1. For this, a latent charge image of a charge image carrier is inked by means of electrophoresis with the aid of a liquid developer. The toner image created in such a manner is transferred to the recording medium indirectly (via a transfer element) or directly. The liquid developer has toner particles and carrier fluid in a desired ratio. The toner particles are suspended in the carrier fluid. This allows the use of small toner particles with a diameter of less than 8 μm, for example. If such small particles are handled as powder, they pose a health hazard. In contrast to this, if they are suspended in a carrier fluid, no health hazard exists. The use of such small toner particles on the one hand allows a print image with very high resolution since the toner particles are smaller than given conventional electrophoretic printing methods in which no carrier fluid is used. Furthermore, the layer thickness of the toner particles on the recording medium is less. This is advantageous in particular when multiple colors are printed atop one another. The toner particles incur the greatest costs in the printing process. The smaller the printed toner quantity, the lower the costs as well.

Mineral oil can be used as carrier fluid. In order to provide the toner particles with an electrostatic charge, charge control substances are added to the liquid developer. Further additives may additionally be added, for example in order to achieve the desired viscosity or a desired drying behavior of the liquid developer.

The toner particles are comprised of wax and color particles. In the fixing process, the recording medium with the applied toner particles is heated, whereby the carrier fluid is vaporized. The toner particles are hereby also heated and thermoplastically deformed. The particles flow into one another and bind to the recording medium. The heating of the recording medium thus simultaneously serves to fix the toner particles onto the recording medium and to dry the recording medium.

The carrier fluid vaporized in the fixing station mixes with air and thus forms a flammable gas, is designated in the following as "combustible gas." This combustible gas is supplied to a combustion chamber and burned there. Via the burning of the combustible gas, a waste gas is generated that is not flammable and in which toxic components of the combustible gas are converted into non-toxic components. The combustible gas is heated and the waste gas is cooled with a heat exchanger. If a heat exchanger with high efficiency is used, a bypass line for the waste gas is then provided with which a portion of the waste gas is supplied past the heat exchanger to a chimney. Given fluctuations in the input of the carrier fluid into the combustible gas, in the short term a large quantity of heat may hereby be removed from the system as a whole since the regulation of the air supply for the combustible gas is too slow in order to be adapted to a rapidly changing vapor quantity of carrier fluid.

In offset printing, solvents are vaporized in a fixing station, which solvents—with supplied air—form a combustible gas and are similarly thermally heated in a combustion chamber. However, in offset printing a specific print image is often printed successively, such that the entry of solvent is essentially constant.

In digital printing, successive pages may be printed to with different print images. The entry of carrier fluid or, respectively, the amount of combustible gas may hereby vary significantly. The safety standards for explosion safety (for example DIN EN 1539) require that a thermal preparation system downstream from a heating zone is designed for the maximum possible entry quantity of combustible gas.

In offset printing, only the solvent is dried off from applied color particles, but these are not thermoplastically deformed. A print image generated in digital printing with the liquid developer explained above is significantly more stable than a print image generated in offset printing, since it can no longer be dissolved due to the thermoplastic deformation.

It is also known that ink may have a flammable solvent or also a mineral oil that must be prepared in the printing process, similar to the carrier fluid explained above.

A digital printer with a developer station for inking of charge images on a photoconductor roller using liquid developer emerges from DE 10 2012 111 791 A1. Liquid colors are hereby applied to a recording medium by means of multiple print groups according to a print image defined by print data.

In DE 10 2010 017 239 A1, a printing device is described which has a drying chamber for fixing print images onto a recording medium. The drying chamber possesses a porous burner to generate hot waste gas and infrared radiation. A printing fluid comprises a carrier fluid and coloring pigment [dye] particles. The carrier fluid of the printing fluid vaporizes, whereby a gaseous air/oil mixture is created in the drying chamber, which mixture is influenced with the aid of the hot waste gas of the porous burner.

EP 1 155 844 A2 discloses a method and a device for adjusting the register in a multicolor printing machine. Multiple partial color images are printed with this multicolor printing machine, wherein the creation and merging of the partial color images should be directly controlled with regard to a register adjustment, such that prints that are in register are achieved. A change to a toner profile should not lead to a register error. This is achieved in that, given a change to a toner profile, the influence of the toner profile on the register is directly taken into account by means of existing influencing variables with the implementation of the change. The influencing variables of different toner profiles may be determined according to the extent of the areal coverage of the total image region by the partial color images. In this way, it is not necessary to re-measure the influencing variables for each print page; rather, it is sufficient to determine the extent of the areal coverage of the total image region for each partial color image and, for all print groups, to either calculate the influencing variables from these data or determine them from a prepared tabular file.

In DE 10 2006 012 940 B3, a device is described for fixing toner images applied on a recording medium. This device has a fixing station with at least one gas burner. Toner images are fixed on the recording medium with a gas flame in that thermoplastic properties of a toner are used: the toner is liquefied so that it merges and bonds with the recording medium.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
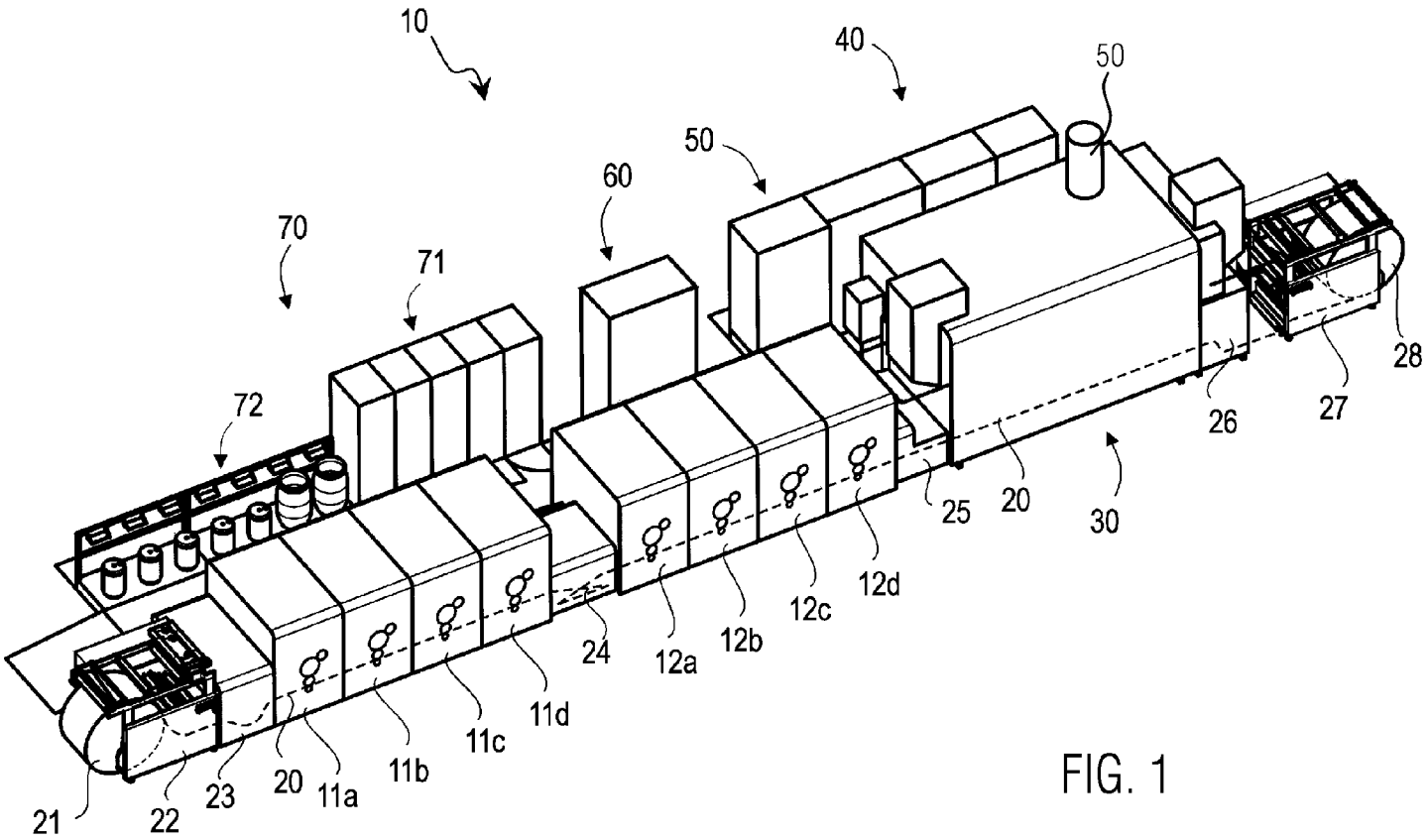
FIG. 1 is a perspective view of a liquid toner printing apparatus according to an exemplary embodiment.
Figure 2:
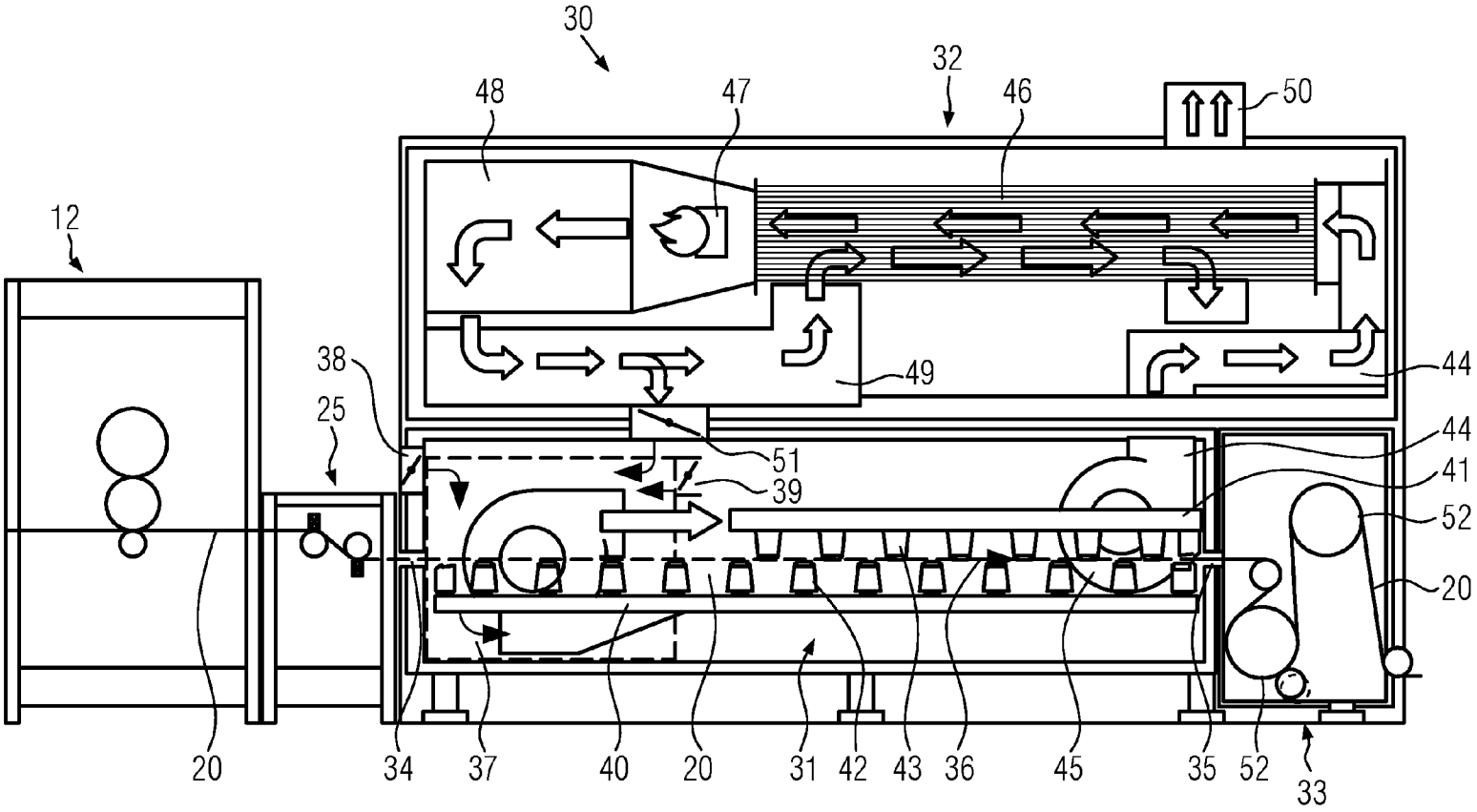
FIG. 2 is a fixing station according to an exemplary embodiment of the liquid toner printing apparatus from FIG. 1.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

The disclosure describes methods and devices for digital printing to a recording medium with liquid print color, with which combustible gas made up of air and the vapor of the carrier fluid may be reliably thermally prepared, and the corresponding devices for thermal preparation are as compact and cost-effective as possible.

A method according to exemplary embodiments of the disclosure for digital printing to a recording medium with liquid print color that includes a flammable carrier fluid including pigment, a print image defined by print data is printed onto the recording medium via application of the liquid print color by means of print groups, and after the application of the liquid toner the recording medium is heated to evaporate the liquid print color. Upon heating, air is supplied which mixes with the vapor to form a combustible gas, which is supplied to a combustion chamber in which it is burned to form waste gas.

The disclosure describes that print control data ca be generated from the print data, which print control data serve to activate the print groups, wherein an areal coverage (defined by the print control data) which describes the amount of color applied onto the recording medium by means of the liquid toner is limited to a predetermined maximum average areal coverage within a predetermined averaging area.

The disclosure is based on the realization that the theoretical maximum areal coverage that may be applied onto a recording medium with such a method is not reasonable given use of multiple print groups for application of different liquid print colors, since given application of all colors at full saturation a dark brown or a dark black is achieved that may also be represented with a significantly smaller areal coverage. A significantly smaller areal coverage is thus sufficient to depict a specific color space. According to an exemplary embodiment of the disclosure, the areal coverage is limited to a value that is markedly smaller than the maximum theoretical areal coverage. Via this limitation of the average areal covering it is ensured that only a limited amount of liquid print color is applied to the recording medium. Accordingly, the carrier fluid applied to the recording medium is also limited. Since the applied quantity of carrier fluid is limited by the maximum average areal coverage, the maximum amount of combustible gas that is created upon heating the recording medium is also limited. The corresponding devices for thermal preparation may therefore be designed for this limited maximum amount of combustible gas. The devices for thermal preparation—for example a heat exchanger, a burner, a combustion chamber and a chimney—may hereby be of significantly smaller design than if the theoretical maximum amount of carrier fluid that can be applied to the recording medium with the print groups were to be considered.

In an exemplary embodiment, the maximum average areal coverage given four print groups is in a range from 200% to 280% per side, and in particular in a range from 220% to 250% per side, wherein an areal coverage of 100% corresponds to a complete coverage of the recording medium with a single color with maximum saturation. The average areal coverage is not limited to these exemplary values.

A theoretical maximum areal coverage of 400% is possible given a printing device with four print groups to print to a side; of 700% is possible given a printing device with seven print groups for printing to a side; and of 800% is possible given a printing device with four respective print groups for printing to the front side and back side of the recording medium.

Each print group whose color is not printed onto the recording medium on a specific side nevertheless causes an application of the carrier fluid. Given a print group not printing a color, the application of carrier fluid amounts to approximately 30% to 50% of the areal coverage of 100%. This application amount is designated in the following as a minimum application. Given more than four print groups, for each additional print group the maximum average areal coverage is respectively to be increased by the corresponding minimum application of 30% to 50%.

If a recording medium is printed to on both sides, in an exemplary embodiment, the maximum average areal coverage includes the color application from both sides.

A maximum local areal coverage may be greater than the maximum average areal coverage. In principle, the maximum local areal coverage may amount to the theoretical maximum areal coverage. However, it is appropriate to also limit the maximum local areal coverage to a value that is less than the maximum theoretical areal coverage. Given four print groups, in an exemplary embodiment, the maximum local areal coverage amounts to approximately 300% to 400% per side, and in particular to not more than 360% per side. In an exemplary embodiment, the maximum theoretical areal coverage is to be respectively increased by the minimum application of 30% to 50% for each additional print group.

The recording medium is heated in a heating chamber, and the predetermined averaging area is smaller than the area of the recording medium that is located within the heating chamber at a specific point in time. It is hereby ensured that no more carrier fluid than is determined by the average areal coverage is supplied the heating chamber.

In an exemplary embodiment, the printing device comprises a controller configured to convert (translate) the print data into print control data. The controller can include processor circuitry configured to perform one or more functions of the controller, including the conversion of print data into print control data. The print data are transmitted to the controller by means of a print job. The print job normally includes the print data and a job ticket. The print data are converted into the print control data in that a respective color separation is generated for the individual liquid colors or liquid toners or inks. One or more rastering steps or dithering steps may also hereby be executed. The print control data respectively describe an image point in a color separation with one bit.

In principle, it is also possible that the conversion of the print data into print control data takes place in a print server outside of the printing device without the maximum average areal coverage thereby being limited. In such a case, the controller of the printing device may determine the average areal coverage of the print control data and—in the event that it exceeds a predetermined threshold—may suppress the printout of these print control data.

According to an exemplary embodiment, the areal coverage is taken into account for controlling the air supply upon heating the recording medium, wherein the amount of supplied air is controlled proportionally to the areal coverage. Since the print data are in principle already known before the printing process in which the liquid print color is applied onto the recording medium, the areal coverage may already be determined before the printing process. From this it is known how much carrier fluid is transferred onto the recording medium and is introduced into a heating chamber due to the printing process, in which heating chamber the recording medium is heated to fix the pigment and in particular the toner particles of the liquid toner, and to vaporize the carrier fluid. Air is supplied to the heating chamber by means of a blower, wherein the reaction time is known that is present between changing a control signal for the blower and the corresponding change to the supplied quantity of air.

Since the areal coverage is already known before the printing process, the blower may be activated such that the supplied quantity of air is always proportional to the carrier fluid introduced into the heating chamber. The proportion of vaporized carrier fluid in combustible gas may hereby be kept approximately constant. This has the consequence that—even given a use of a heat exchanger with high efficiency—no bypass line is necessary since, given a large amount of introduced carrier fluid, a correspondingly large amount of air is supplied, such that the entire volume flow changes accordingly, whereby in the combustion chamber it is not the temperature of the waste gas but rather the quantity of waste gas that increases or decreases. It is hereby unnecessary to divert hot waste gas directly past the heat exchanger; rather, the waste gas may always be directed across the heat exchanger.

The changes at the entry of the carrier fluid into the heating chamber are thus not compensated via a bypass line or a change to the fuel supply, but rather via an early change to the air supply into the heating chamber. This is significantly simpler and more efficiency since the consumption of fuel or no bypass line are necessary. In addition to this, the waste gas temperature may be kept lower than given a device with bypass line, whereby the thermal requirements for the materials (in particular steels) bounding the combustion chamber, the heat exchanger and a chimney are significantly lower. Steels that are not heated over 850° C. are significantly more cost-effective than steels that are thermally stable up to temperatures of 1,000° C.

In an exemplary embodiment, a waste gas return feed is provided to return a portion of the waste gas from the combustion chamber to the heating chamber. With the waste gas return feed, the heat that is contained in the waste gas is supplied to the heating chamber. Furthermore, via a waste gas return feed the proportion of toxic waste gases (in particular of carbon monoxide) in the waste gases discharged to the environment may be reduced.

Fuel may be supplied into the combustion chamber as needed. This primarily serves to keep the combustion process stable given very small quantities of introduced carrier fluid, and to keep the temperature of the waste gas in the combustion chamber at a specified minimum temperature. In an exemplary embodiment, the minimum temperature is at least 700° C. or 750° C., in particular 760° C. In an exemplary embodiment, the temperature is at least 765° C. in order to ensure that the combustible portions in the combustible gas are completely burned or substantially burned.

Furthermore, in an exemplary embodiment, the supplied quantity of fuel is controlled such that the combustion temperature is less than or equal to a predetermined maximum temperature. In an exemplary embodiment, the maximum temperature is 900° C. or 870° C., in particular 850° C. In an exemplary embodiment, the temperature is 845° C. The lower the maximum temperature, the lower as well the requirements for the materials that bound the combustion chamber and all additional modules through which the waste gas is directed.

Given a longer combustion chamber, the minimum temperature and the maximum temperature to satisfy the necessary waste gas values may be adjusted to be lower than given a shorter combustion chamber.

In an exemplary embodiment, a device for digital printing to a recording medium with liquid print color that comprises a carrier fluid including a pigment, where a print image defined by print data is printed onto the recording medium via application of the liquid toner, comprises

- a heating chamber configured to heat the recording medium, after application of the liquid print color onto said recording medium, to vaporize the carrier fluid,
- a blower configured to supply air to the heating chamber, the air mixing with the vapor to form a combustible gas, and
- a combustion chamber configured to burn the combustible gas to form waste gas.

This device can include a controller that includes processor circuitry that is configured to generate print control data from the print data, which print control data serve to control the print groups, wherein the areal coverage determined by the print control data—which areal coverage describes the amount of color applied onto the recording medium by means of the carrier fluid—is limited to a predetermined maximum average areal coverage within a predetermined averaging area.

In an exemplary embodiment, the controller is configured to execute the method explained above.

An exemplary embodiment of a digital printing system that comprises a digital printer 10 is shown in FIG. 1.

According to FIG. 1, the digital printer 10 for printing to a recording medium 20 has one or more print groups 11*a*-11*d* and 12*a*-12*d* that print a toner image (print image) onto the recording medium 20. As shown, a web-shaped recording medium 20 as a recording medium 20 is unspooled from a roll 21 with the aid of a take-off 22 and is supplied to the first print group 11*a*. The print image is fixed on the recording medium 20 in a fixer 30. The recording medium 20 may subsequently be taken up on a roll 28 with the aid of a take-up 27. Such a configuration is also designated as a roll-to-roll printer.

In the exemplary configuration shown in FIG. 1, the web-shaped recording medium 20 is printed to in full color on the front side with four print groups 11*a* through 11*d* and on the back side with four print groups 12*a* through 12*d* (what is known as a 4/4 configuration).

Additional typical configurations of the digital printer may comprise four print groups that print only to one side (what is known as a 4/0 configuration) or up to seven print groups that print to one side (what is known as a 7/0 configuration). In principle, other additional configurations for one-sided or two-sided printing to a recording medium are also possible. This depends on whether the user would like to print to the recording medium with no spot colors, one spot color or multiple spot colors.

The recording medium 20 is unspooled from the roll 21 by the take-off 22 and supplied to the first print group 11*a* via an optional conditioning group 23. In the conditioning group 23, the recording medium 20 may be pre-treated or coated with a suitable substance. In an exemplary embodiment, wax, or chemically equivalent substances, may be used as a coating substance (also designated as a primer).

This substance may be applied over the entire surface, or only to the points of the recording medium 20 that are to be printed to later, in order to prepare the recording medium 20 for printing and/or to affect the absorption behavior of the recording medium 20 upon application of the print image. With this it is prevented that the toner particles or carrier fluid that are applied later do not penetrate too deeply into the recording medium 20, but rather remain essentially on the surface (color quality and image quality are thereby improved).

The recording medium 20 is subsequently supplied first, in order, to the first print groups 11*a* through 11*d* in which only the front side is printed to. Each print group 11*a*-11*d* typically prints to the recording medium 20 in a different color or also with different toner material, for example MICR toner which can be read electromagnetically.

After printing to the front side, the recording medium 20 may be turned in a turner 24 and be supplied to the remaining print groups 12*a*-12*d* for printing to the back side. In the region of the turner 24, an additional conditioning group (not shown) may optionally be arranged via which the recording medium 20 is prepared for the printing to the back side, for example a fixing (partial fixing) or other conditioning of the previously printed front side print image (or of the entire front side, or also the back side). It is thus prevented that the front-side print image is mechanically damaged upon further transport through the subsequent print groups.

In order to achieve a full-color printing, at least four colors (and therefore at least four print groups 11, 12) are required, and in fact the primary colors YMCK (Yellow, Magenta, Cyan and Black), for example. Still more print groups 11, 12 with special colors (for example customer-specific colors or additional primary colors in order to expand the printable color space) may also be used.

Arranged after the print group 12*d* is a register 25 via which registration marks—which are printed on the recording medium 20 independently of the print image (in particular outside of the print image)—are evaluated. The transversal and longitudinal registration (the primary color dots that form a color point should be arranged atop one another or spatially very close to one another; this is also designated as color registration or four-color registration) and the register (front side and back side must spatially coincide precisely) can therefore be adjusted so that a qualitatively good print image is achieved.

Arranged after the register 25 is the fixer 30 via which the print image is fixed on the recording medium 20. In an exemplary embodiment, given electrophoretic digital printers, a thermal dryer as fixer 30 is used that largely vaporizes the carrier fluid so that only the toner particles still remain on the recording medium 20. The toner particles may thereby also be fused onto the recording medium 20 insofar as they comprise a material (resin, for example) that can melt as a result of the effect of heat. The fixer is explained in further detail below.

Arranged after the fixer 30 is a puller 26 that pulls the recording medium 20 through all print groups 11*a*-12*d* and the fixer 30, without an additional drive being arranged in this region. The danger that the as of yet unfixed print image could be smeared would exist due to a friction drive for the recording medium 20.

The puller 26 feeds the recording medium 20 to the take-up 27, which rolls up the printed recording medium 20.

Centrally arranged in the print groups 11, 12 and the fixer 30 are all supply devices for the digital printer 10, such as air-conditioning modules 60, power supply 61, controller 2 (controller), fluid management modules 70 (such as fluid controller 71 and reservoirs 72 of the different fluids). In particular, pure carrier fluid, highly-concentrated liquid toner (high proportion of toner particles in relation to carrier fluid) and serum (liquid toner plus charge control substances) are required as fluids in order to supply the digital printer 10, as well as waste containers for fluids to be disposed of or containers for cleaning fluid.

The digital printer 10, with its structurally identical print groups 11, 12, is of modular design. The print groups 11, 12 do not differ mechanically, but rather only due to the liquid toner (toner color or toner type) used therein.

Such a print group 11, 12 is based on the electrophotographic principle, in which a photoelectric image carrier is inked with charged toner particles with the aid of a liquid toner, and the image that is created in such a manner is transferred to the recording medium 20.

The print group 11, 12 is essentially comprised of an electrophotography station, a developer station and a transfer station.

The fixer 30 comprises a heating chamber 31 in which the recording medium 20 is heated in order to fix the toner particles and vaporize the carrier fluid, as well as a thermal cleaning system 32 in order to thermally prepare combustible gas created in the heating chamber 31. Furthermore, a belt cooler 33 is provided in the fixer 30 in order to again cool the recording medium 20 heated in the heating chamber 31. The heating chamber 31 has a slot-shaped inlet 34 and a slot-shaped outlet 35 through which the web-shaped recording medium 20 is supplied to or discharged from the heating chamber 31. Within the heating chamber 31, the recording medium 20 is moved in the transport direction 36 along a horizontal conveyor path. Adjacent to the inlet 34, a heating fan 37 is provided to the side of the heating chamber 31. The heating blower 27 comprises a blower and a heater. The heating fan 37 has two air inlets: a fresh air inlet 38 and a circulation air inlet 39. Both air inlets 38, 39 are openings in the heating blower 37 that may respectively be opened and closed via a flap. The fresh air inlet 38 is an opening in the heating blower 37 that leads to the outside (relative to the heating chamber 31) so that fresh ambient air may be drawn in through this. The circulation air inlet 39 is an opening in the heating blower that leads further into the inner region of the heating chamber 31, such that air may hereby be drawn out of the heating chamber and be re-dispensed into the heating chamber.

Arranged above and below the transport path of the recording medium 20 are air channels 40, 41 which have nozzles 42, 43 which are aligned with the openings for the transport path of the recording medium 20. The air channels 40, 41 are arranged so that they accept the heated air supplied from the heating blower 37 and direct this via their nozzles 42, 43 in the direction of the recording medium. The temperature of this hot air output from the heating blower 37 typically amounts to approximately 180° C. to 300° C.

The hot air supplied via the nozzles 42, 43 heats the recording medium such that the toner particles located thereupon are thermoplastically deformed and fixed on the recording medium 20. At the same time, the carrier fluid applied onto the recording medium 20 vaporizes. The carrier fluid is a flammable liquid, in particular mineral oil. The vapor of the carrier fluid mixes with the hot air to form a flammable gas that is designated as "combustible gas" in the following.

An escape line 44 leads from the heating chamber 31 to the thermal cleaning systems 32. In the escape line 44, an escape blower 45 is provided with which a defined quantity of combustible gas may be drawn out of the heating chamber 31 and supplied to the thermal cleaning system 32. The escape line 44 opens into a heat exchanger 46. The combustible gas is supplied via the heat exchanger 46 to a burner 47 that is located within a combustion chamber 48. The burner 47 is connected with a fuel line (not shown) via which additional fuel may be supplied. In an exemplary embodiment, gaseous fuel—in particular natural gas—is used here as a fuel.

In the combustion chamber 48, the combustible gas is burned to form exhaust air. An exhaust channel 49 leads from the combustion chamber to the heat exchanger 46, in which the exhaust air is directed in a counterflow relative to the combustible gas. The exhaust air is hereby cooled via the heat exchange with the combustible gas. The counterflow line of the heat exchanger 46 opens into a chimney 50 through which the exhaust air is discharged to the environment.

The exhaust air channel is connected via an opening 51 with the heating chamber 31. In the opening 51, a flap to close and open the opening 51 is provided so that a defined quantity of exhaust air may be directed back into the heating chamber 31. Via the return of a portion of the exhaust air into the heating chamber, energy is on the one hand supplied to said heating chamber, and on the other hand the emissions values may be improved via the recirculation of the exhaust air.

The belt cooler 33 has multiple rollers 52 around which the belt-shaped recording medium is directed. At least one of the rollers 52 is cooled so that the recording medium 20 is cooled after the heating in the heating chamber 31.

In the following, the operation of the printing system according to the disclosure with the fixing station 30 explained above is explained in detail.

The recording medium 20 is directed through the heating chamber 31 in the transport direction 36 at a predetermined production velocity (for example 1 m/s to 3 m/s). The recording medium is normally comprised of paper and is heated to a temperature of at least 120° C. by means of the hot air supplied via the nozzles 42, 43. Depending on the type and quality of the recording medium, temperatures of 120° C. to 300° C. are appropriate here.

The combustible gas (which comprises air and the vapor of the carrier fluid) which is hereby created has a temperature of approximately 450° C. This combustible gas is supplied via the exhaust line 44 from the heating chamber 31 to the heat exchanger 46 of the thermal cleaning system 32. In the heat exchanger 46, the combustible gas is heated to a temperature of approximately 450° C. and supplied to the burner 47. In the combustion chamber 48, the combustible gas is converted into waste gas by burning it. Given a low proportion of carrier fluid vapor, fuel may hereby be additionally supplied to the burner 47 in order to ensure a stable combustion. The waste gas that is hereby generated has a temperature of approximately 750° C. to 850° C. In an exemplary embodiment, the burning process is regulated such that the temperature of the waste gas is in a range from 760° C. to 770° C., and in particular is 765°. A minimum temperature of approximately 750° C., and in particular of 760° C., is appropriate since a complete combustion of the flammable parts of the combustible gas is hereby ensured, and the proportion of carbon monoxide may be kept low.

The hot waste gas is supplied via the escape line 44 to the heat exchanger 46 and flows through this in a counterflow relative to the combustible gas. The temperature of the waste gas is hereby reduced to approximately 450° C. This cooled waste gas may be output to the environment via the chimney 50.

Figure 3:
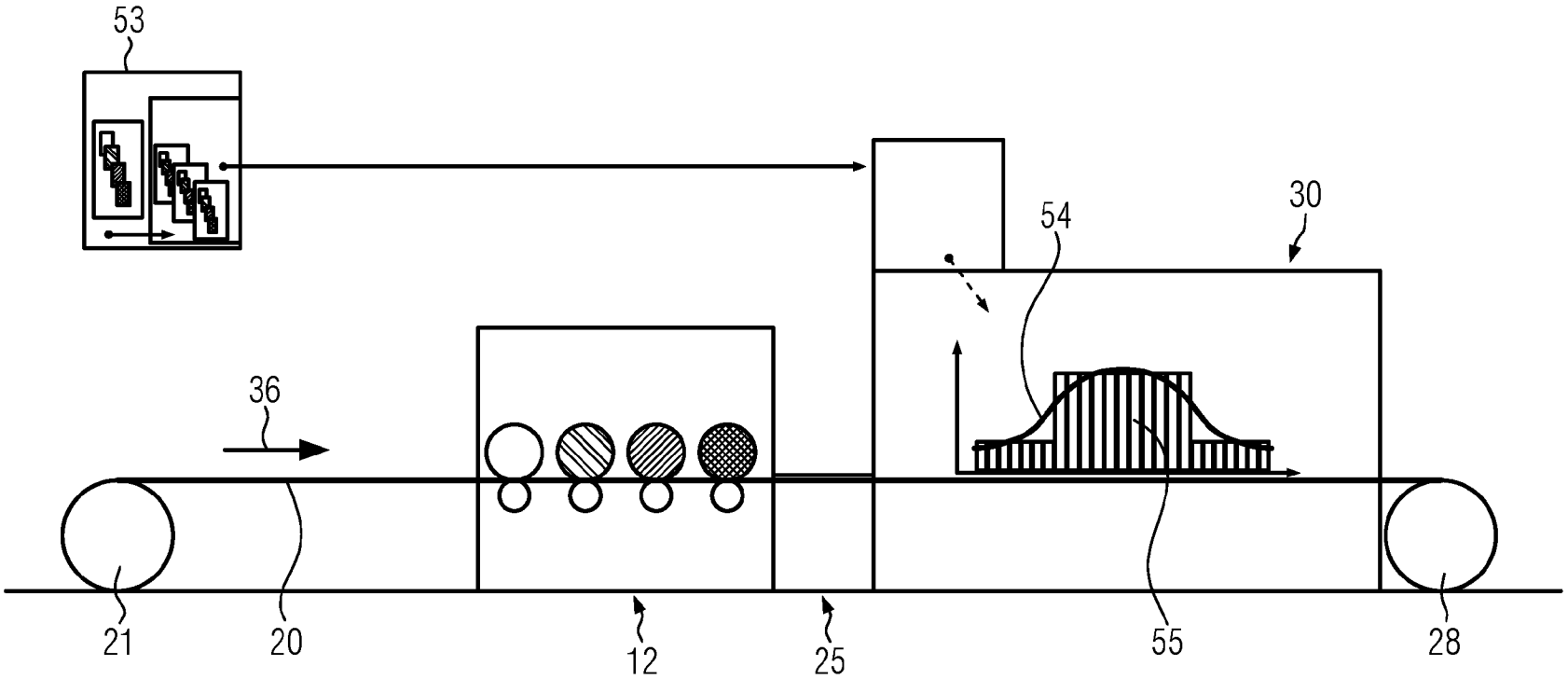
FIG. 3 is a block diagram illustrating an exemplary interaction between a controller and the printing system from FIGS. 1 and 2.

According to the disclosure, a controller 53 is provided (FIG. 3) which limits the areal coverage of the recording medium with ink. In the present exemplary embodiment, the areal coverage is calculated for each side. Within the scope of the disclosure, other surface regions (for example every sheet that comprises multiple sides, or multiple specific sides, or multiple sheets) may also be used to calculate the areal coverage. When which side with what areal coverage is supplied to the heating chamber 31 is known using the transport velocity, the point in time of printing, and the transport path from the print groups to the heating chamber 31. The areal coverage is proportional to the supplied quantity of flammable carrier fluid.

In the print groups 11, 12, if the corresponding print group is in operation a defined proportion of carrier fluid is always applied to the recording medium, even if the recording medium is not to be printed to with ink. The rollers in contact with the recording medium cannot be made completely free of carrier fluid, such that a carrier fluid is transferred onto the recording medium even in regions with which no liquid toner should be applied with one of these print groups. The proportion of this "minimum application" of carrier fluid is approximately 30% to 50%, wherein a proportion of 100% of the carrier fluid of a complete printing of the recording medium corresponds to maximum saturation of the color.

In digital printing, the areal coverage may vary from side to side. The further proportion in addition to the minimum application of carrier fluid is proportional to the areal coverage of the respective color.

In an exemplary embodiment, the controller 53 is configured to limit a maximum average areal coverage, wherein the maximum average areal coverage is in a range from 200% to 280% per side, and in particular approximately 220% to 250%, given four print groups. It is hereby ensured that only the minimum charge of carrier fluid that cannot be avoided and only a specific further maximum quantity of carrier fluid that is proportional to the average areal coverage is introduced into the heating chamber 31. The quantity of combustible gas that is hereby generated is thus also limited by the average areal coverage limited in advance. In principle, it is hereby not possible to introduce more than this limited quantity of carrier fluid into the heating chamber 31. The devices for thermal preparation of the combustible gas that are explained above—for example the heat exchanger 46, the burner 47, the combustion chamber 48, the exhaust channel 49 and the chimney 50—may be designed corresponding to this limited quantity of combustible gas. Significant costs are hereby saved relative to a design on the basis of the theoretical maximum quantity of carrier fluid that can be introduced.

In an exemplary embodiment, the limitation of the areal coverage takes place upon conversion of the print data into print control data, wherein the combination of the individual colors is optimized with regard to the applied quantity of liquid toner.

In the present exemplary embodiment, the maximum average areal coverage is determined within a respective side that represents the predetermined averaging area. If the determined average areal coverage exceeds the value of the maximum average areal coverage, there are different possibilities for compensating this. The individual pages may be rearranged so that an average areal coverage across adjacent sides within a larger averaging area is in total below the maximum average areal coverage. Such a rearrangement of the pages is stored and considered in the post-processing of the recording medium. If such an arrangement of the reordered pages is not possible, the print data may then be reconverted into print control data, wherein a reduced quantity of color is used. Information that is included in a job ticket is hereby taken into account as well. In certain print jobs it is possible to vary the color saturation, and thus to comply with the maximum average areal coverage. In the event that it is not possible to modify the print control data such that the maximum average areal coverage may be complied with, the print job is then to be rejected. However, it has been shown that in nearly all print jobs it is possible to comply with a maximum average areal coverage in a range from 200% to 300% per side with at most four print groups.

Furthermore, when and how much carrier fluid is supplied to the heating chamber 31 may be determined using the areal coverage. In an exemplary embodiment, this "prediction" of the quantity of carrier fluid is already determined chronologically a bit before the supply of the carrier fluid to the heating chamber 31, so that the heating blower 37 may be activated at the correct time. The heating blower 37 requires a specific reaction time between the receipt of the signal that the quantity of the air flow should change until the air flow is actually adjusted to the desired quantity. This reaction time is known and lies in a range from 0.5 s to 5 s. The air flow generated by the heating blower 37 is approximately proportional to the introduced quantity of carrier fluid, such that the proportion of the carrier fluid vapor in the combustible gas is approximately constant. So that the supplied air quantity adjusts synchronously with the supplied quantity of carrier fluid, the control signal regarding the air quantity is supplied by the controller 53 to the heating blower 37 with an advance of the necessary reaction time.

In an exemplary embodiment, the control signal regarding the air quantity (which is proportional to the supplied quantity of carrier fluid) is smoothed since the supplied quantity of carrier fluid may vary erratically.

The supplied air quantity is approximately proportional to the supplied quantity of carrier fluid. The quantity of fuel supplied directly to the burner 47 may also be taken into account as well in the determination of the air quantity, such that the air quantity is increased corresponding to the supplied fuel quantity. It may also be appropriate to vary the air quantity due to the recirculation of the exhaust air into the heating chamber.

Printing with liquid toner at high efficiency is possible with this method. The liquid toner comprises the carrier fluid and toner particles. In an exemplary embodiment, the toner particles have a size of not more than 8 μm.

With this method it is avoided that a bypass is provided for the exhaust air to the heat exchanger. Such a bypass line is disadvantageous since: it is firstly very complicated and expensive due to the high waste gas temperatures; secondly is controlled by means of a flap that generates strong flow pulses that affect the entire flow mechanics in the cleaning system and the heating chamber; and additionally the chimney must be designed for correspondingly hot waste gases, which requires the use of very expensive materials. In addition to this, with the method according to the disclosure the addition of fuel may be kept very slight since the proportion of vaporized carrier fluid in the combustible gas always remains approximately the same.

The exemplary embodiment explained above has a liquid toner printing apparatus for printing to a recording medium with liquid toner. Within the scope of the disclosure it is also possible that the printing apparatus is designed as an inkjet printing apparatus, wherein then the print group has one or more inkjet print heads for printing to the recording medium with ink.

In the exemplary embodiment explained above, the combustible gas is subjected to a thermal combustion. Within the scope of the disclosure it is also possible to prepare the combustible gas by means of a catalytic afterburning.

The heat exchanger used in the exemplary embodiment explained above is operated in a reverse current. However, a heat exchanger may also be provided that is operated in parallel flow or cross flow.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, processor circuitry can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 digital printer
11, 11*a*-11*d* print group (front side)
12, 12*a*-12*d* print group (back side)
20 recording medium
21 roll (input)
22 take-off
23 conditioning group
24 turner
25 register
26 puller
27 take-up
28 roll (output)
30 fixer
31 heating chamber
32 thermal cleaning system
33 belt cooling system (belt cooler)
34 slot-shaped inlet
35 slot-shaped outlet
36 transport direction
37 heating blower
38 fresh air inlet
39 circulation inlet
40 air channel
41 air channel
42 nozzle
43 nozzle
44 escape line
45 escape blower
46 heat exchanger
47 burner
48 combustion chamber
49 exhaust air channel
50 chimney
51 opening
52 roll
53 controller
60 climate control module
61 power supply
70 fluid management
71 fluid controller
72 reservoir

What is claimed is:

1. A method for digital printing to a recording medium with liquid print ink that includes a flammable carrier fluid having pigment, a print image that is defined by print data being printed onto the recording medium using print groups via application of multiple different liquid print colors, and after the application of the liquid print colors onto the recording medium, said recording medium being heated to vaporize the carrier fluid, wherein upon heating, air is supplied which mixes with the vapor to form a combustible gas that is supplied to a combustion chamber and converted into waste gas, the method comprising:

generating print control data from the print data, said print control data activating the print groups, wherein an areal coverage determined via the print control data is limited to a predetermined maximum average areal coverage within a predetermined averaging area, the areal coverage describing the quantity of color applied onto the recording medium by a respective one of the liquid print colors, and the predetermined maximum average areal coverage being less than a maximum theoretical areal coverage; and heating the recording medium in a heating chamber, wherein the predetermined averaging area is smaller than an area of the recording medium located within the heating chamber at a point in time.

2. The method according to claim 1, wherein the maximum average areal coverage is in a range from 200% to 300% given up to four print groups, wherein an areal coverage of 100% corresponds to a complete printing of the recording medium with a color with maximum saturation on one side, and given more than four print groups, the maximum average areal coverage increases by a minimum application for a fifth and every additional print group, the minimum application being in a range from 30% to 50% per print group and side.

3. The method according to claim 2, wherein the maximum average areal coverage is in a range 220% to 280%.

4. The method according to claim 1, wherein the recording medium is printed to on both sides, and the maximum average areal coverage includes the color separation of both sides.

5. The method according to claim 1, wherein a maximum average areal coverage of 300% to 400% given four print groups is permissible, wherein the areal coverage includes the color separation on one side, and given more than four print groups, the maximum average areal coverage increases by a minimum application in a range from 30% to 50% per print group and side for a fifth and each additional print group.

6. The method according to claim 1, wherein, in response to the areal coverage exceeding a predetermined threshold, the method further comprises at least one of:

suppressing the output of print control data, reordering of pages, and reducing the color quantity.

7. The method according to claim 1, wherein the device for digital printing comprises multiple print groups, and the more print groups that are in operation, the less the average areal coverage.

8. The method according to claim 1, wherein a liquid print color of the liquid print colors comprises at least one of:

a liquid toner including mineral oil; and an ink including a flammable solvent.

9. A non-transitory computer-readable storage medium having an executable program stored thereon, when executed, causes a processor to perform the method of claim 1.

10. A device for digital printing to a recording medium with liquid print color having pigment contained in a flammable carrier fluid, a print image defined by print data being printed onto the recording medium using the liquid print color, the device comprising:

a fixer including:

a heating chamber configured to heat the recording medium to vaporize the flammable carrier fluid after application of the liquid print color onto said recording medium;

a blower configured to supply air into the heating chamber, the air mixing with the vapor to form a combustible gas; and a combustion chamber configured to burn the combustible gas to form waste gas; and a controller configured to:

generate print control data based on the print data, the print control data activating print groups; and limit an areal coverage to a predetermined maximum average areal coverage within a predetermined averaging area, the areal coverage being determined via the print control data and describes a quantity of color applied onto the recording medium by the carrier fluid, and the predetermined maximum average areal coverage being smaller than a maximum theoretical areal coverage, and the recording medium being heated in a heating chamber, wherein the predetermined averaging area is smaller than an area of the recording medium that is located within the heating chamber at a point in time.

11. The device according to claim 10, further comprising:

a heat exchanger configured to heat the combustible gas and cool the waste gas to be discharged to an environment.

12. The device according to claim 10, further comprising:

a waste gas return feed configured to return the waste gas from the combustible gas to the heating chamber.

13. The device according to claim 10, wherein the print groups are provided for application of the liquid print color to the recording medium.

14. A method for digital printing to a recording medium with liquid print ink that includes a flammable carrier, the method comprising:

generating print control data from print data, said print control data activating one or more print groups to print to the recording medium;

determining an areal coverage based on the print control data, the areal coverage corresponding to a quantity of color applied onto the recording medium;

limiting the determined areal coverage to a predetermined maximum average areal coverage within a predetermined averaging area, the predetermined maximum average areal coverage being less than a maximum theoretical areal coverage; and heating the recording medium in a heating chamber, wherein the predetermined averaging area is smaller than an area of the recording medium located within the heating chamber.

* * * * *